US005767437A

United States Patent [19]

Rogers

[11] Patent Number: 5,767,437

[45] Date of Patent: Jun. 16, 1998

[54] DIGITAL REMOTE PYROTACTIC FIRING MECHANISM

[76] Inventor: Donald L. Rogers, 3911 69th St., Des Moines, Iowa 50322

[21] Appl. No.: 822,084

[22] Filed: Mar. 20, 1997

[51] Int. Cl.[6] ..... F42C 7/00; F23Q 7/02

[52] U.S. Cl. ..... 102/200; 102/217; 102/215; 361/249

[58] Field of Search ..... 102/200, 206, 102/215, 217, 320, 360; 361/247, 248, 249

[56] References Cited

U.S. PATENT DOCUMENTS

| | | | |
|---|---|---|---|
| Re. 33,004 | 8/1989 | Kirby et al. | 102/200 |
| 3,760,732 | 9/1973 | Schuster et al. | 102/215 |
| 4,051,907 | 10/1977 | Estes | 102/320 |
| 4,848,232 | 7/1989 | Kurokawa et al. | 102/206 |
| 4,862,802 | 9/1989 | Streifer et al. | 102/201 |
| 4,884,506 | 12/1989 | Guerreri | 102/200 |
| 4,930,393 | 6/1990 | Castro, Jr. | 102/206 |
| 5,014,622 | 5/1991 | Julian | 102/217 |
| 5,069,129 | 12/1991 | Kunitomo | 102/217 |
| 5,090,321 | 2/1992 | Abouav | 102/215 |
| 5,189,246 | 2/1993 | Marsh et al. | 102/217 |
| 5,235,127 | 8/1993 | Findley | 102/200 |
| 5,284,094 | 2/1994 | La Mura et al. | 102/217 |
| 5,404,820 | 4/1995 | Hendrix | 102/201 |
| 5,520,114 | 5/1996 | Guimard et al. | 102/215 |

*Primary Examiner*—Charles T. Jordan
*Assistant Examiner*—Theresa M. Wesson
*Attorney, Agent, or Firm*—James D. Birkenholz

[57] ABSTRACT

A digital remote pyrotactic firing unit for the controlled selection and ignition of a pyrotactic device. An operator manually selects a specific output channel, which generates a Binary Code Decimal signal. The binary code decimal signal is received by a remote ignition circuit unit that is connected to the pyrotactic device and generates an ignition signal from being energized by an enabling firing circuit.

3 Claims, 6 Drawing Sheets

DIGITAL REMOTE PYROTACTIC FIRING MECHANISM

BACKGROUND OF THE INVENTION

1. Field of the Invention

The present invention relates generally to pyrotactic firing devices, and more particularly to a selective remote pyrotactic firing device utilizing integrated circuits.

2. Description of Prior Art In the field of pyrotactic technology where multiple devices are controllably ignited, a single ignition device, i.e., fuse or match, is typically used to ignite a wick or fuse on the device. The safety issues presented with this type of ignition are very significant, particularly where multiple devices are ignited in a relatively short duration of time. This type of ignition typically requires the use of a "burning fuse" ignition device, which can be problematic and unreliable.

In recent years the overall complexity of firework displays have significantly increased in terms of the product itself and the need to precisely control the ignition of the pyrotechnic device. An operator would ideally be located at a remote location and selectively ignite fireworks while still exercising ultimate control over the ignition. This would allow the party to take into account multiple variable factors, which would overall impact the visual display presented.

The art in this area does include attempts to create controllable pyrotechnic ignition devices. In La Mura, U.S. Pat. No. 5,284,094, a pyrotechnic ignition device is disclosed utilizing multiple magazines wherein the ignition of all devices within the magazine occurs. La Mura is directed towards the apparatus for the simulation of military arms training and represents a fairly complex and detailed approach to this problem. In Jullian, U.S. Pat. No. 5,014,622, a blasting delayed ignitor system is taught where the sequentially controlled ignition of explosion is disclosed. Jullian, while applicable to commercial blasting applications, is again overall complex in detail and would not be readily adaptable to pyrotactic firing devices typically in a conventional fireworks display.

There is a need for pyrotactic firing device that is reliable, simple to use, and offers flexibility in terms of ignition sequences.

SUMMARY OF THE INVENTION

A digital remote pyrotactic firing unit for the controlled selection and ignition of a pyrotactic device. A Binary Code Decimal signal, which corresponds to a specific output channel of the selected controlled circuit, is fed to a remote ignition circuit connected to a pyrotactic device and generates an ignition signal for ignition of the pyrotactic device corresponding to the binary code decimal output channel. The ignition signal is generated on activation of the enabling firing circuit, which generates a firing control signal. The firing control signal is used to activate an and gate to energize a specific transistor, which turns a selective binary code decimal decoder.

DESCRIPTION OF THE DRAWINGS

FIG. 3 *a* illustrates the and gate array of the selective control circuit;

DESCRIPTION OF THE PREFERRED EMBODIMENT

Figure 1:
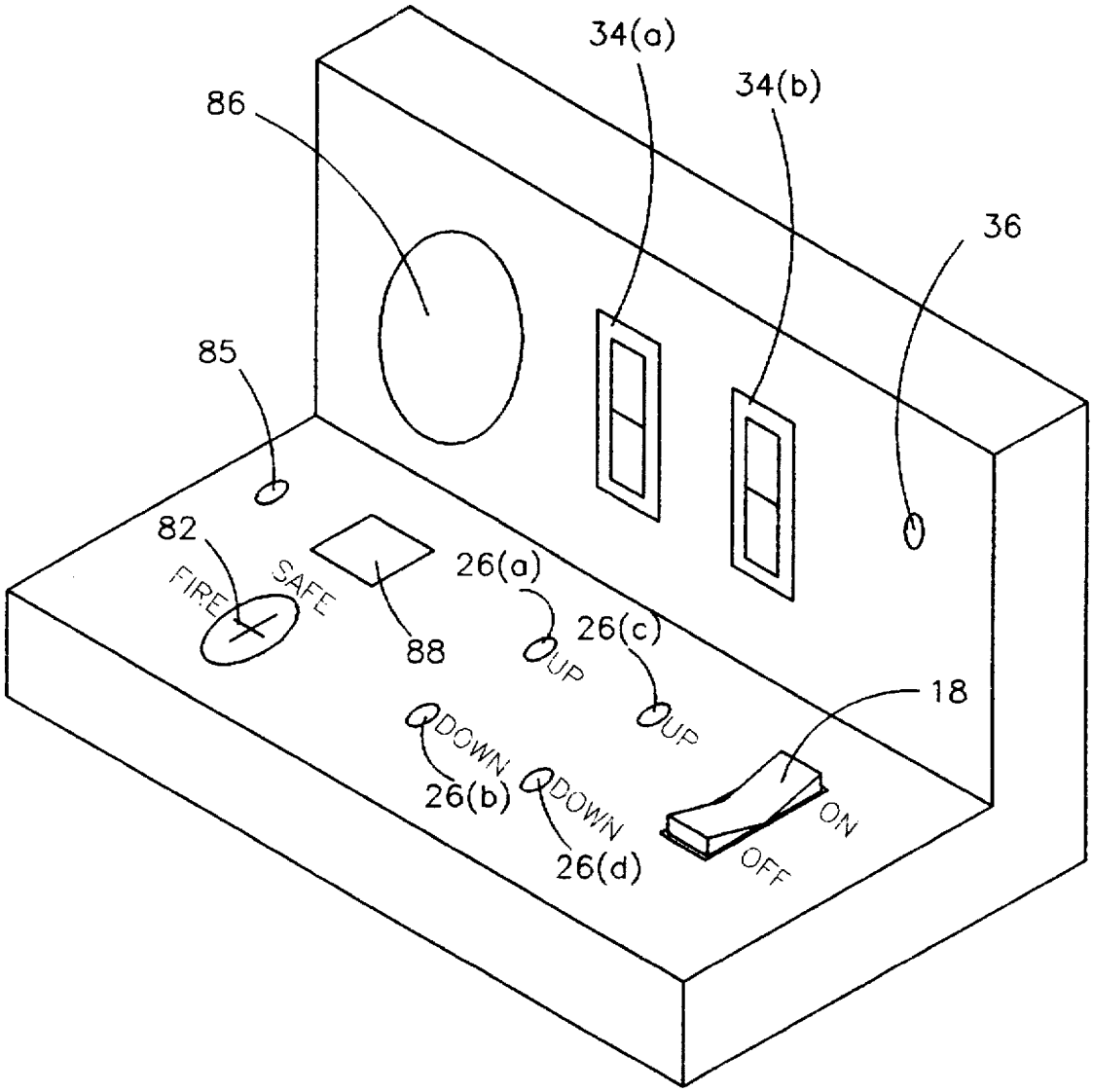
FIG. 1 illustrates the central box of the digital remote pyrotactic firing unit of the present invention.
Figure 2:
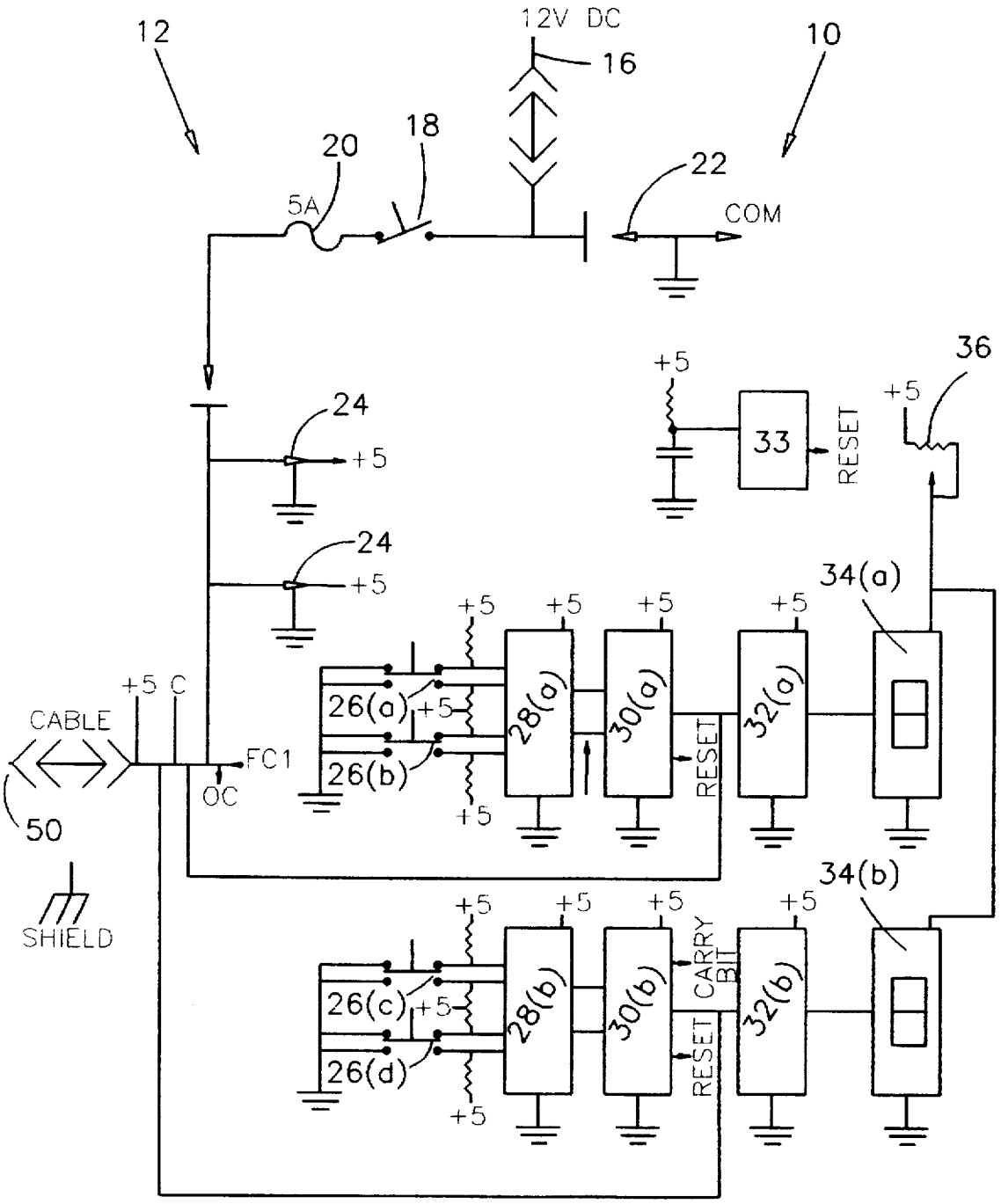
FIG. 2 illustrates a schematic diagram of the selective control circuit.
Figure 3A:
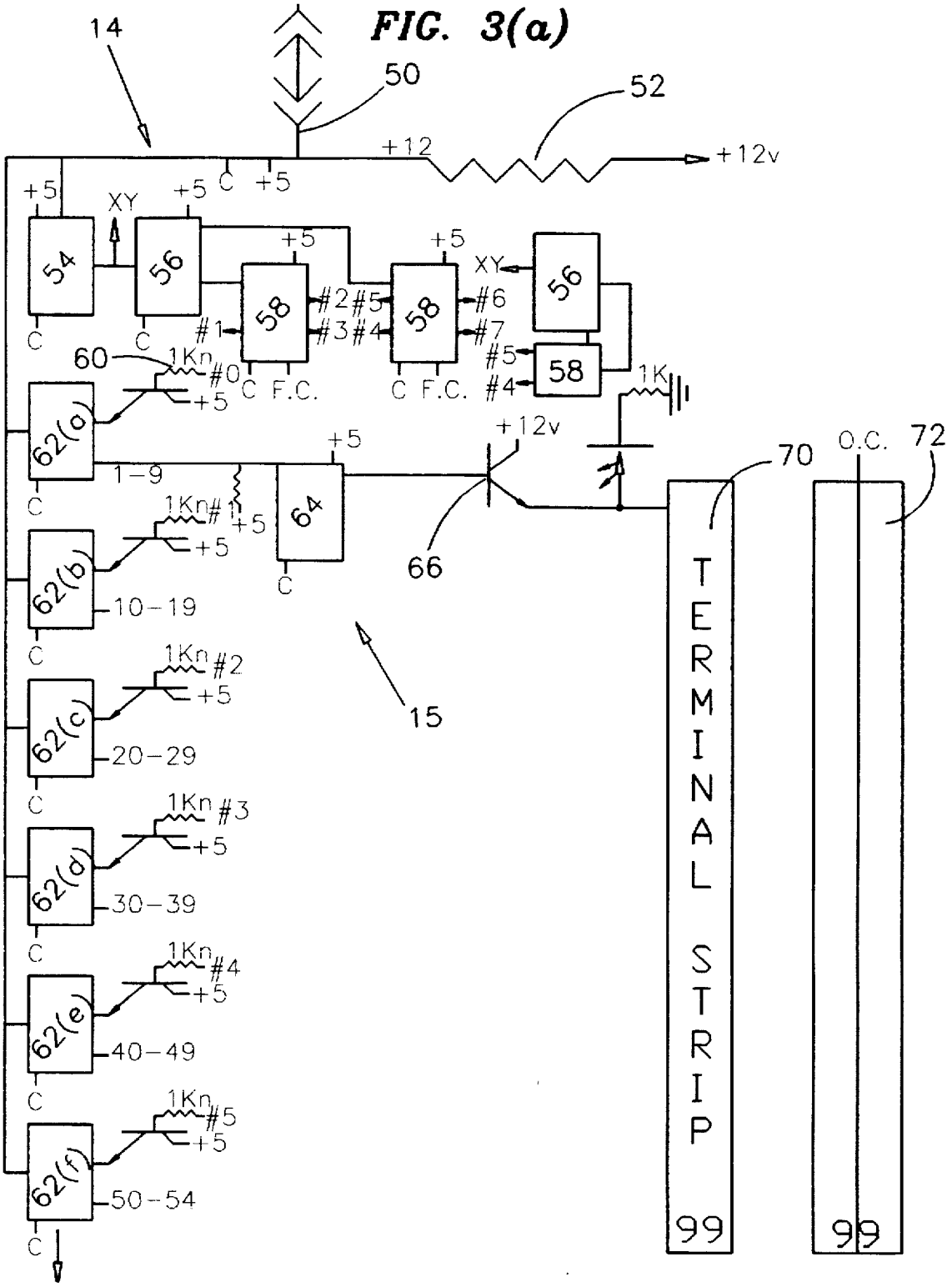
FIG. 3 illustrates the remote ignition circuit.
Figure 3B:
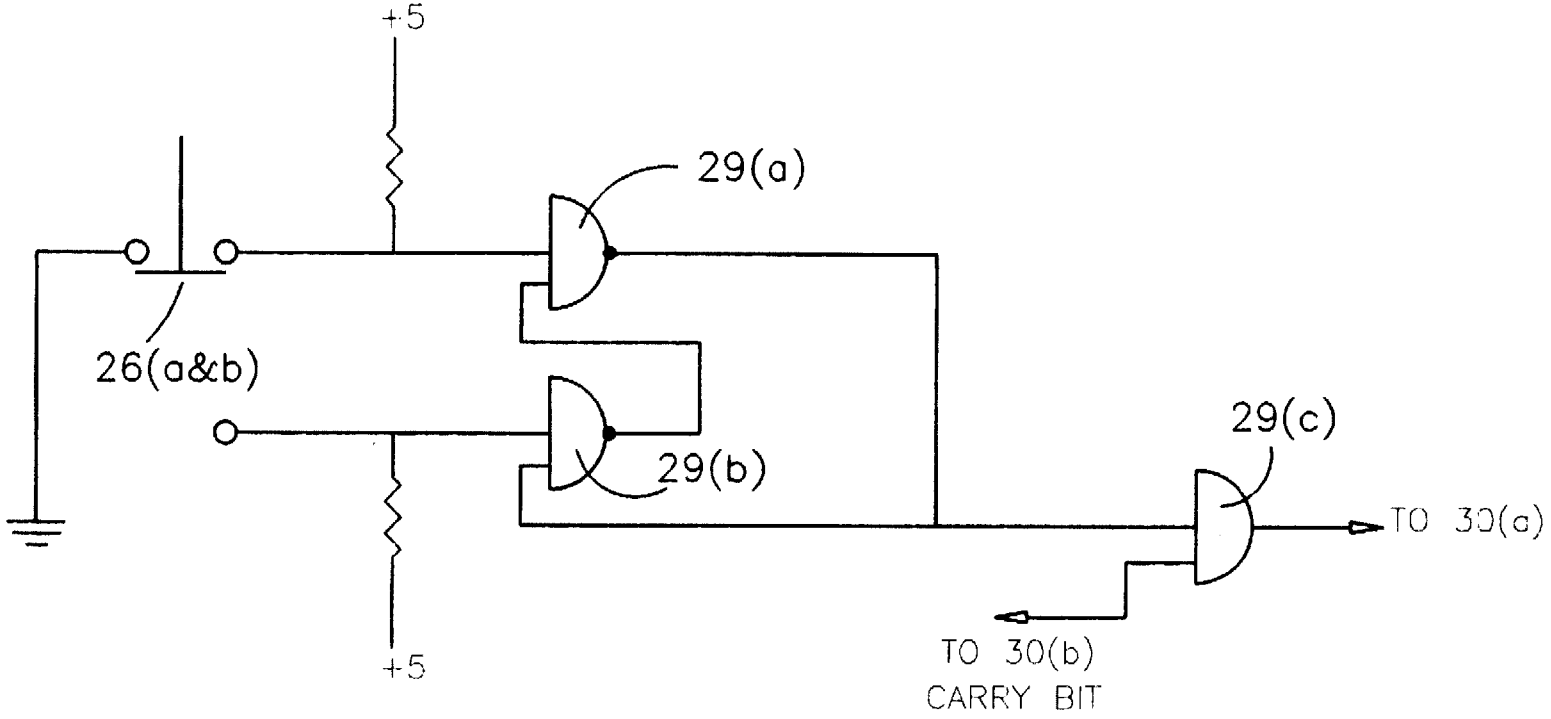
Figure 4:
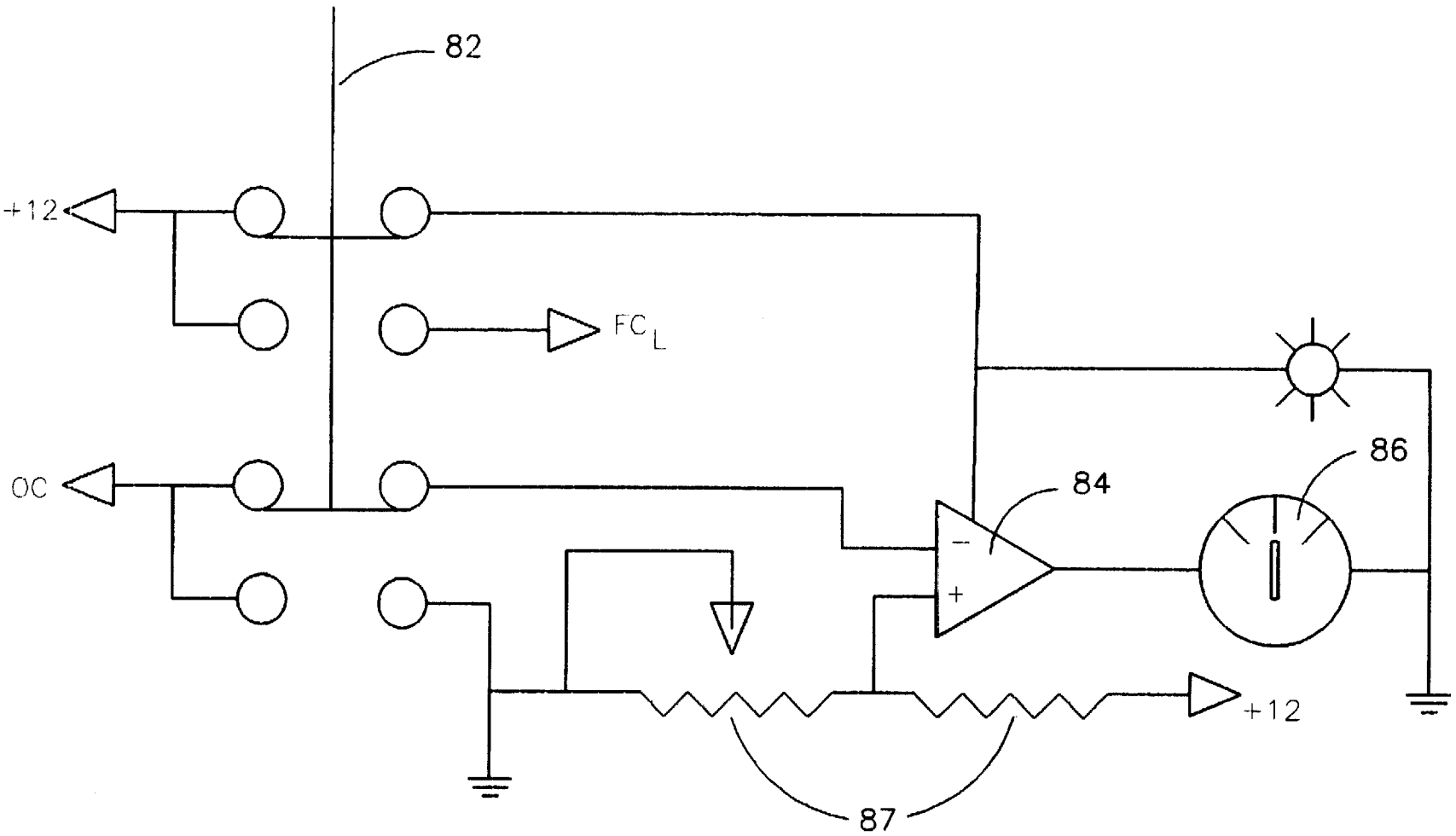
FIG. 4 illustrates the safe-fire selector switch components of the enabling firing circuit.

Referring to the drawings wherein reference numerals designate identical or corresponding parts throughout the several views. A digital remote pyrotactic firing unit 10 (FIG. 3) includes a selective control circuit 12, an enabling firing circuit 14, (FIG. 3) and remote ignition circuit 15 (FIG. 3). The selective control circuit 12 includes a power supply 16, which is capable of supplying not less than 12 volts DC and not more than 36 volts DC with a minimum 6 amp capability. The power supply is fed through a conventional on/off switch 18 with a conventional 5 amp inline fuse 20. Diodes 22 are provided inline to prevent reverse polarity. A pair of conventional 5 volt regulators 24 are provided to give a Vcc 5 volt supply source. Two pairs of up/down counting switches 26(*a*), (*b*), (*c*), and (*d*) are connected to the respective inputs of 7400 logic nand gate arrays 28(*a*) and (*b*). Nand gate arrays 28(*a*) and (*b*) are provided for debounce and are of conventional design as illustrated in FIG. 3*a*. The nand gate arrays 28(*a*) and (*b*) include a nand gates 29(*a*) and (*b*) tied to and gate 29(*c*). The second input to and gates 29(*c*) is the carry bit from a counter 30(*b*). FIG. 3*a* illustrates the particular nand gate array 28(*a*) and the nand gate arrays 28(*b*) would be similar in design as described above. The output of the nand gate arrays 28(*a*) and (*b*) are fed to 74192 up/down decade counters 30(*a*) and 30(*b*) through the up count pin. The output from the counters 30(*a*) and 30(*b*) is binary coded decimal and is first directed to 2032 decoder/drivers 32(*a*) and 32(*b*), which are seven segment drivers which drive 3080 seven segment displays 34(*a*) and 34(*b*). The output from the counters 30(*a*) and 30(*b*) are also fed to the remote ignition circuit 15 (FIG. 3). Rheostat 36 (FIG. 2) is provided on the displays 34(*a*) and 34(*b*) to control the brightness of the displays 34(*a*) and 34(*b*). The ones unit 34(*b*) is the designated binary coded decimal signal (a)–(d) and includes counting switches 26(*c*) and 26(*d*), nand gate array 28(*b*), decade counter 30(*b*), decoder driver 32(*b*) and display 34(*b*). The tens unit 34(*a*) provides the binary coded decimal signal (e)–(h) and includes counting switches 26(*a*) and 26(*b*), nand gate array 28(*a*), decade counter 30(*a*), driver 32(*a*), and display 34(*a*). The remote ignition circuit 15 (FIG. 3) is connected to the control circuit 12 by conventional cable 50 having multiple conductors and typically shielded. The cable supplies the 5 and 12 volt supply, common, a fire signal, the ones and tens units binary coded decimal signals, and the output common. The 12 volt supply is routed to a 3 oHm 50 watt resistor 52 to limit current of the output.

The ones unit binary coded decimal signal (a)–(d) is routed to 7445 decoders 62(*a*)-(*f*). For purposes of the drawing, decoders 62 (*a*)–(*f*) are illustrated, however, it should be understood a minimum of ten decoders 62 (*a*)–(*j*) is utilized for the ones unit binary coded decimal signal representing numerals 0, 1, 2, 3, 4, 5, 6, 7, 8, and 9. The (a)–(d) ones signal is fed to each of decoders 62(*a*)–(*j*) and as illustrated 62(*a*) would be designated as the zero unit decoder, 62(*b*) would be the ones unit decoder, and etc . . . , through the last decoder, which would be designated the nines unit decoder. The tens unit binary coded decimal signal (e)–(h) is first fed to a single 7445 decoder 54. Decoder 54 will receive the tens unit signal 0 through 9. The output from each decoder 62(*a*)–(*j*) is fed through a 7404 invertor 64. The output of the invertor 64 is then used to fire transistor 66. The transistor 66 is a 184 transistor and in turn supplies a 12 volt fire voltage to a terminal strip 70.

Figure 5:
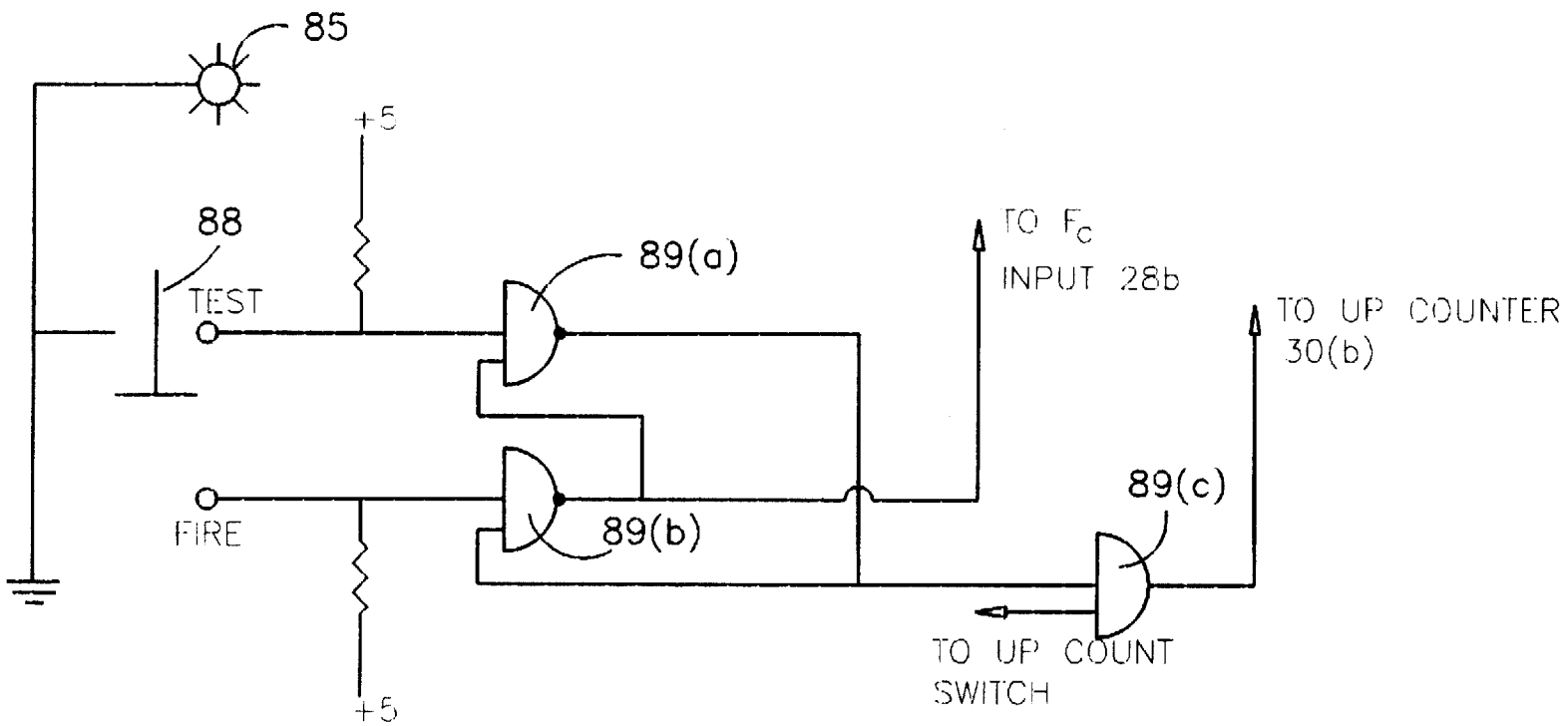
FIG. 5 illustrates the fire button portion of the enabling firing circuit.

The enabling firing circuit 14 (FIGS. 1, 3, 4, and 5) includes a conventional double pole double throw safe-fire selector switch 82, which when turned to the "safe" mode provides a 12 volt supply to a 741 op amp 84 and when turned to the "fire" mode provides a 12 volt signal to a visual display lamp 85. When the safe-fire selector switch 82 is in the safe mode, power is also supplied to the meter 86 and its accompanying light. The safe-fire selector switch 82 in the safe mode allows the output common lead from the terminal strip 72 to be fed into one of the inputs of the Op amp 84. Resistors 87 provide the adjustment for the other input of the Op amp 84. When the safe-fire selector switch 82 is switched to the fire mode, output common lead from the terminal strip 72 is tied directly to ground. During the test mode, the switch 82 is turned to the "safe" mode and fire button 88 is depressed. Meter 86, which would normally display a high reading, would immediately drop establishing full continuity of the circuit. The full 12 volt supply is fed through the terminal strips 70 and 72, however, minimal current is available and actual firing of the device does not occur. Upon the safe-fire selector switch 82 being moved to the "fire" mode (FIG. 5), the fire light 85 is lighted. Fire button 88 is a single throw double pole switch, which is tied to nand gates 89 (*a*) and (*b*). Upon depressing the fire button 88, the output of nand gate 89(*b*) is fed to and gates 58 (FIG. 3). The output from the nand gate 89(*b*) referred to as the F.C. (fire control) signal being received by the and gate 58, the 5 volt vcc supply voltage output from the respective and gate 58 is fed to transistor 60. This operates the transistor 60 to provide vcc to the proper decoder 62(*a*)–(*f*). The output from and gate 89(*c*) is also fed to the upcount input on counter 30(*b*) and the second input on the and gate 89(*c*) is also connected to the up switch 26(*c*) and (*d*) to provide operation of the upcount feature upon the depressing of the switches 26(*c*) and (*d*).

During operation of the digital remote pyrotactic firing unit 10, detonator wires are connected to the proper terminals on the terminal strip 70 and output common strip 72. The detonators are typically referred to as squibs in the trade and are generally lengths of wire with an electrical resistance heating element joining the ends, which is sometimes covered with an ignitable substance which ignites when the heating element is heated, which in turn results in ignition of the pyrotactic device. The terminal strip 70 and output common strip 72 are fitted with corresponding terminals numbering 1 through 99 in this embodiment, however, there may be additional terminals provided on further expansion of the capacity of the firing unit 10 beyond the operational number 99. The power supply is connected to the unit 10 and a control circuit 12 is typically removed from the ignition circuit 15. The on/off switch 18 is turned on with the safe-fire selector switch 82 in the safe mode. An initial reading on the displays 34(*a*) and (*b*) will be 00. A 555 timer 33 is used as a power up one shot and is tied to the reset pins of the counters 30(*a*) and (*b*). Upon power up, the timer 33 resets both counters 30 (*a*) and (*b*) to "0" and thereafter times out to allow the counters 30(*a*) and (*b*) to operate. The switches 26(*a*), (*b*), (*c*), and (*d*) allow the tens and ones unit displays 34(*a*) and (*b*) to be selectively advanced and decreased to correspond to the desired terminal number on the terminal strip 70 and output common strip 72. In the conventional operation of the unit 10, for example, displays 34(*a*) and (*b*) are showing "01", counter 30(*b*) is feeding the binary coded decimal signal of "1" to the decoders 62(*a*)–(*j*) and counter 30(*a*) is feeding the binary coded decimal signal "0" to the tens unit decoder 54. The decoder 54 through the appropriate output feeds the invertor 56, which is tied to the respective and gate 58 and the and gate 58 in turn is tied to respective transistor 60. Each output "0–19" from the decoder 54 would be tied to a separate invertor 56, and gate 58 and transistor 60. However, until the fire control button 88 is depressed, the and gate 58 is not energized and transistor 60 is not turned on to provide Vcc to decoders 62(*a*)–(*j*). Upon the depressing of the fire switch 88, the 5 volt Vcc is supplied to the and gates 58 and the respective binary coded decimal signal from decoder 54, in turn provides an output to transistor 60, which provides Vcc to 62(*a*)–(*j*). Upon the decoder 62(*a*)–(*j*) being energized, the decoder 62(*a*)–(*j*) output is fed to an invertor 64, which turns on transistor 66, which provides 12 volt fire voltage to the detonator wires 90 connected to terminal strip 70 and output common strip 72. This in turn ignites the pyrotactic firing device. Upon releasing the fire button 88, the circuit illustrated in FIG. 5 will advance the decade counter 30(*b*) one unit, which will have the effect of advancing the count by one numeral each time the fire switch 88 is de-activated. Further, a carrier feed is provided on an output of the counter 30(*b*) to provide an advancement of the tens unit of the counter 30(*a* ). The ones unit signal (a)–(d) being fed to the decoder 62(*a*)–(*j*) is constant and each decoder receives the binary coded decimal signal. The actual decoder 62(*a*)–(*j*), which is energized is determined by the binary coded decimal signal which fed to the decoder 54, which through the firing circuit 14 is energized by providing Vcc to the proper decoder 62(*a*)–(*f*). The drawings illustrate as previously discussed decoders 62(*a*)–(*j*), however, it should be understood a minimum of ten decoders would be required and 99 invertor 64 and transistors 66 would be required to operate the unit. These are not illustrated because of the obvious space limitations of the drawings. Further expansion of the unit 10 beyond 99 devices would entail a third level of components representing the hundreds unit. The drawings do not illustrate and the preferred embodiment does not disclose each and every wiring circuit connection, which would be required to operate the invention. It should be understood that within the art the basic requirements of the circuit and wiring configurations would be required. These are not illustrated and generally not included in the discussion, however, it should be understood all components of the design would be required to have appropriate power supply, ground connections, and etc.

The unit 10 provides a safe and efficient control and specific designation of an ignition signal to a fireworks device while allowing the operator ability to safely check the system and to randomly operate the unit 10 by selecting in random fashion any order of ignition of the fireworks device.

Obviously, many modifications and variations of the present invention are possible in light of the above teachings. It is, therefore, to be understood that, within the scope of the pending claims, the invention may be practiced otherwise than as specifically described. To the extent other embodiments are herein created, it is intended they fall within the scope of protection provided by the claims appended hereto.

I claim:

1. A digital remote pyrotactic firing unit for the specific selection and remote ignition of a pyrotactic device, comprising:

a selective control circuit for the specific selection of a determinable output channel and the controlled generation of a signal corresponding to the determinable output channel, including a power supply for supplying a source of electrical energy, a plurality of up/down counting switches, each counting switch connected to the power supply and manually operated to provide an up/down counting sequence, a plurality of nand gate arrays, each nand gate array connected to an up/down counting switch, and a first and second decade counter, each decade counter connected to a nand gate array and to a visual display unit and providing a binary code decimal output signal, the first decade counter providing an output to the display unit representing a tens unit and the second decade counter providing output to the display unit representing the ones unit wherein an output channel is selected corresponding to the representation on the visual display unit and binary code decimal output signal;

a remote ignition circuit connected to the selective control circuit and the pyrotactic device for the generation of an ignition signal corresponding to the determinable output channel of the selective control circuit, including a plurality of ones unit decoders, each ones unit decoder connected to the second decade counter and receiving the binary code decimal signal forming the ones unit signal from the decade counter and providing an output corresponding to the binary code decimal signal, a tens unit decoder, the tens unit decoder connected to the first binary counter and receiving the binary code decimal signal from the first binary counter representing the tens unit signal and providing an output corresponding to the binary code decimal signal, and an ignition signal for providing an ignition signal to the pyrotactic device upon energization of the selected ones unit decoder; and an enabling firing circuit connected to the selective control circuit and the ignition circuit for the generation of a controlled firing signal to the ignition circuit, including a plurality of invertors, each invertor connected to an output of the tens unit decoder, a plurality of and gates, each and gate connected to the output of an invertor, a plurality of transistors, each transistor connected to an and gate and to a ones unit decoder for selectively energizing the ones unit decoder, a firing switch, the firing switch for controllably energizing the and gate wherein the ones unit decoder is energized corresponding to the output channel of the selective control circuit, a safe-fire mode testing circuit to check the continuity of the circuit through a specific output channel, a switch for controllably connecting the pyrotactic device to the power supply, and an operational apparatus connected between the power supply and the pyrotactic device for limiting current flow to the pyrotactic device.

2. The digital remote pyrotactic firing unit as claimed in claim 1, wherein the enabling firing circuit further includes:

a safe-fire mode testing circuit to check the continuity of the circuit through a specific output channel.

3. The safe-fire mode testing circuit as claimed in claim 2 further includes:

a switch for controllably connecting the pyrotactic device to the power supply;

an operational apparatus connected between the power supply and the pyrotactic device for limiting current flow to the pyrotactic device.

* * * * *